US006210032B1

(12) United States Patent
Murphy

(10) Patent No.: US 6,210,032 B1
(45) Date of Patent: Apr. 3, 2001

(54) STIRRING PITCHER HAVING PIVOTING STIRRING HANDLE

(75) Inventor: David J. Murphy, Chicago, IL (US)

(73) Assignee: Sierra Housewares, Inc., Chicago, IL (US)

( * ) Notice: Subject to any disclaimer, the term of this patent is extended or adjusted under 35 U.S.C. 154(b) by 0 days.

(21) Appl. No.: 09/533,146

(22) Filed: Mar. 23, 2000

Related U.S. Application Data

(63) Continuation of application No. 09/354,678, filed on Jul. 16, 1999, now Pat. No. 6,086,240.

(51) Int. Cl.[7] ..... B01F 11/04; B01F 15/06

(52) U.S. Cl. ..... 366/147; 366/243

(58) Field of Search ..... 366/130, 144, 366/147, 241–243, 255, 276–278, 342, 343; 99/348

(56) References Cited

U.S. PATENT DOCUMENTS

| | | | | |
|---|---|---|---|---|
| 2,993 | * | 3/1843 | Lindley et al. . | |
| 135,761 | * | 2/1873 | Borton et al. . | |
| 383,938 | * | 6/1888 | Bitterman et al. . | |
| 437,331 | * | 9/1890 | Busgett . | |
| 477,063 | * | 6/1892 | Parker . | |
| 681,386 | * | 8/1901 | Beynon . | |
| 1,548,614 | * | 8/1925 | Konigsberg . | |
| 1,948,431 | * | 2/1934 | Rolph . | |
| 1,995,998 | * | 3/1935 | Nefedov . | |
| 2,559,196 | * | 7/1951 | Medved . | |
| 3,417,972 | * | 12/1968 | Vincent . | |
| 4,010,934 | * | 3/1977 | McCord et al. . | |
| 4,197,018 | * | 4/1980 | Groen, Jr. | 99/348 |
| 4,460,279 | * | 7/1984 | Krasney | 366/247 |
| 4,893,940 | * | 1/1990 | Waisberg | 366/247 |
| 4,946,286 | * | 8/1990 | Purkapile | 366/277 |
| 5,094,543 | * | 3/1992 | Mursa | 366/247 |
| 5,407,270 | * | 4/1995 | Barile et al. | 366/247 |
| 5,425,579 | * | 6/1995 | Sampson | 366/130 |
| 5,472,274 | * | 12/1995 | Baillie | 366/147 |
| 5,476,321 | * | 12/1995 | McNaughton | 366/241 |
| 5,695,282 | * | 12/1997 | Hess | 366/256 |
| 5,943,947 | * | 9/1999 | Adams | 99/348 |

* cited by examiner

*Primary Examiner*—Charles E. Cooley
(74) *Attorney, Agent, or Firm*—Vangelis Economou; Ladas & Parry

(57) ABSTRACT

A stirring pitcher which is easy to break down for cleaning and which has a uniquely shaped container that has at its bottom a trough with a contour that matches the contour of the stirrer spoon end. The stirrer includes a handle portion that extends above a container cover, and a stirrer portion which extends below the cover. Preferably the stirrer portion is detachable from the handle portion. The stirrer includes a pivot which is transverse to the longitudinal direction of the container trough, so that pivoting of the spoon about the pivot causes the spoon end to sweep the complete volume adjacent the container bottom.

21 Claims, 6 Drawing Sheets

STIRRING PITCHER HAVING PIVOTING STIRRING HANDLE

CROSS-REFERENCE TO RELATED APPLICATIONS

This is a continuation of U.S. patent application Ser. No. 09/354,678, filed on Jul. 16, 1999, now U.S. Pat. No. 6,086,240.

This invention is related to the design disclosed, illustrated and claimed in U.S. patent application Ser. No. 29/104,142, filed on Apr. 29, 1999.

BACKGROUND OF THE INVENTION

1. Field of the Invention

This invention relates generally to pitchers having a manually operated stirring apparatus, and more particularly relates to such pitchers providing a stirring apparatus which is completely enclosed within the pitcher by a cover and is manually operated by means of a handle that extends through the cover.

2. Background Art

Beverage pitchers having manually operated means for mixing together fluid contents within the pitcher are well known. Recent improvements for such pitchers include covers for the pitchers that provide an essentially fluid tight container, but which nevertheless permit the user to stir up the contents of the container without removing the cover. Examples of such stirring or mixing pitchers are described in U.S. Pat. Nos. 5,695,282, 5,407,270, 5,094,543, 4,893, 940, 4,460,279, 4,197,018 and 3,704,007.

Typical problems are encountered in providing a fluid tight cover, including the need for spouts for pouring out the liquid during use. More significantly, a manual stirrer must extend through an aperture, usually extending through the pitcher cover, creating a path of egress from the ambient environment into the pitcher container. Spillage of the fluid within the pitcher resulted. It is also often desired to maintain liquid within the pitcher container cold, and air circulation through an aperture that is not fluid-tight produces undesirable heat transfer which heats up the contained liquid.b The prior art manual mixing mechanisms are often inefficient and/or require substantial manual effort to achieve maximum agitation of the contained liquid and/or entrained solids to achieve total mixing dissolution of the solids within the liquid.

SUMMARY OF THE INVENTION

What is considered necessary is a stirring pitcher that agitates substantially all the liquid within a pitcher container and is capable of dissolving solids within the pitcher container without leaving undisturbed solids in inaccessible corners of the container. It is further desirable to provide a stirring mechanism within a cover that is easily utilizable, easily cleaned and that can provide a substantially complete, fluid-tight seal in the cover to avoid spillage.

The pitcher container including a pivotable stirring handle combination described herein provides for a new and improved combination of beverage pitcher and coacting manually operated mixing apparatus.

The combination of the inventive elements enables one to accomplish a mixing of the liquid contents of a pitcher in a minimum of time and with a minimum of effort but with maximum effectiveness.

The combination can be used so as to cause no spillage during use of the mixing apparatus or when the beverage is dispensed after completion of a mixing operation.

The combination is easily assembled, used and disassembled. The components of the combination are readily and conventionally made from various materials, as the fabricator or user may desire. However, it is presently preferred to construct all components of molded plastic. The combination can be easily and thoroughly cleaned and is durable for extended reuse.

Furthermore, herein is described and claimed a stirring pitcher comprising a container having an upwardly facing container opening; a container cover for covering the upwardly facing container opening, the container cover being removable and replaceable over the container opening to open and close the container opening, the container cover further including a pivot mount; and a pivotable stirrer attachable to the container cover and adapted for extending through a stirrer aperture in the container cover, the stirrer comprising a spoon end, a stirrer handle attachment end oppositely disposed along a longitudinal axis from said spoon end, and a central shaft extending between said spoon end and said stirrer handle attachment end, the central shaft including a pivot pin oriented transversely to the shaft longitudinal axis, whereby the shaft is attachable to the cover at the stirrer aperture such that the pivot engages the pivot mount on the cover, causing the handle attachment end of the stirrer to extend outside the cover and the spoon end of the stirrer to extend within the container when the container cover engages the container to cover the container opening.

In a second embodiment, the container further comprises a shape having at least two side walls, and a bottom wall, the container resembling an elongated trench-like bottom, the container bottom and side walls having a cross-sectional shape following a contour which matches the contour of at least the bottom portion of the spoon end, and the bottom wall of the container defining an arc having a radius located approximately at the pivot pin end of the stirrer central shaft.

BRIEF DESCRIPTION OF THE DRAWING FIGURES

DETAILED DESCRIPTION OF THE PREFERRED EMBODIMENTS

Figure 1:
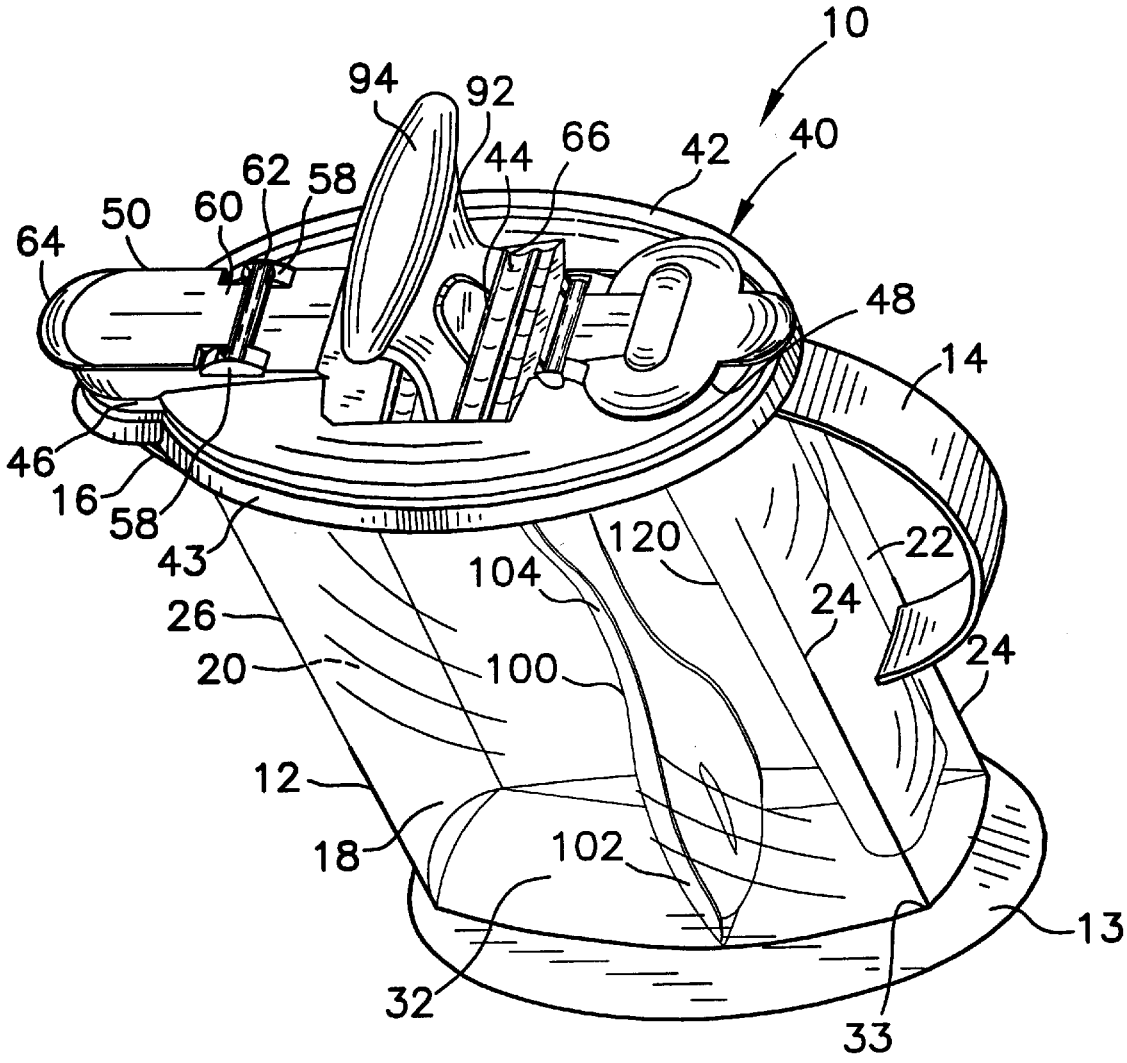
FIG. 1 is a perspective view of an embodiment of a stirring pitcher according to this invention.
Figure 2:
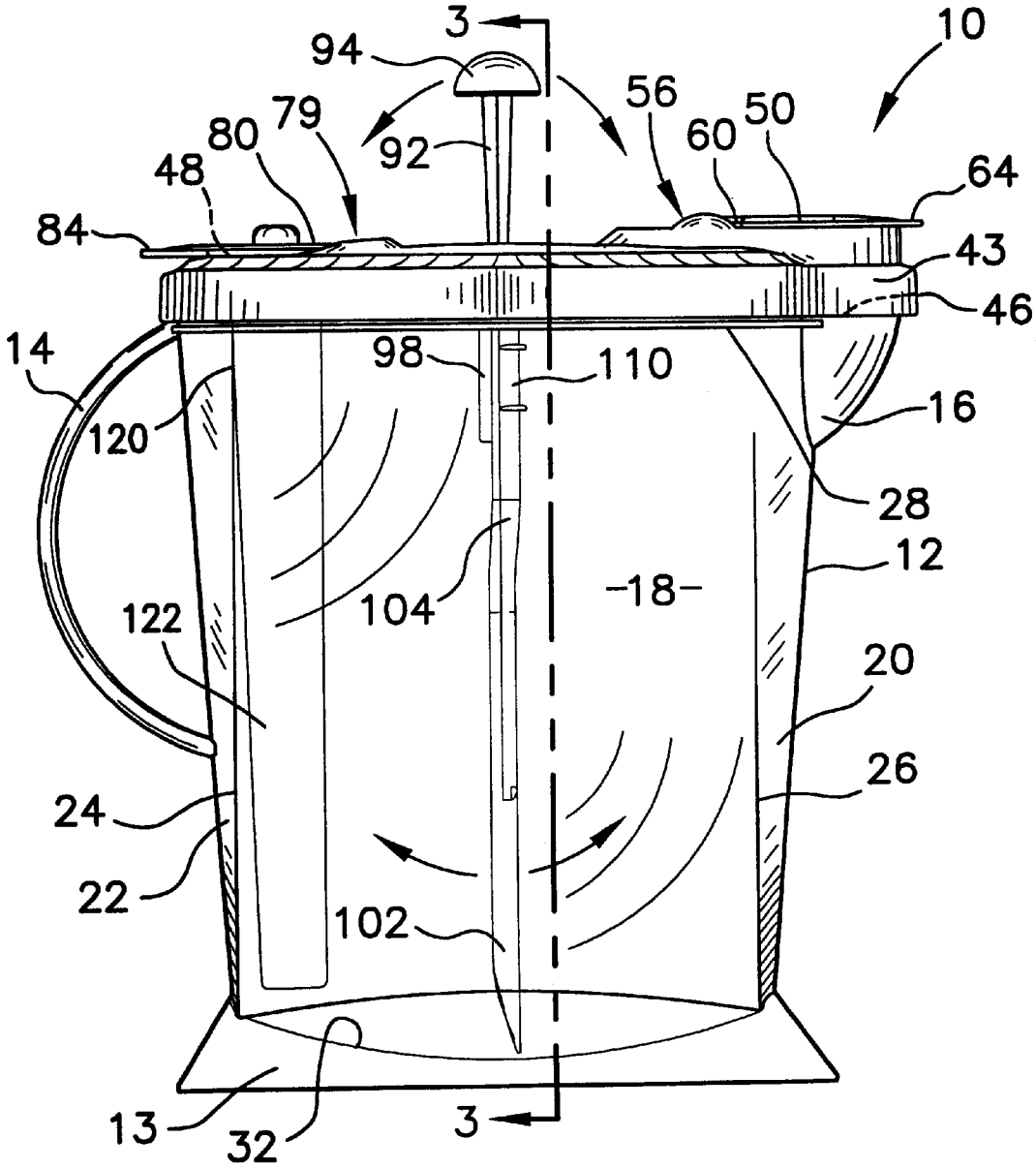
FIG. 2 is an elevational end view of the embodiment of the inventive pitchers shown in FIG. 1.

A stirring pitcher 10 according to the present invention is illustrated in a perspective view in FIG. 1, and in elevation view in FIG. 2. The pitcher 10 comprises a container member 12, having a base 13, a handle 14, a spout 16 and plural walls defining a container for liquid materials. Four such walls are preferred. As shown in the embodiment of FIGS. 1 and 2, these comprise longitudinal walls 18, a spout wall 20 and a handle wall 22. Of course, other configurations may be contemplated by persons having skill in designing such pitchers. For example, the pitcher 12 container is shown having somewhat rounded sides which flare outwardly to a small degree (as viewed best in the cross-sectional view of FIG. 3). The upper rim of the pitcher is also in the shape of an oval at the top.

In an alternative embodiment (not shown) the sides may be vertical, and the container upper rim may be in the shape of a lengthened quadrilateral such as a rectangle or even a square, as long as the sweep of the stirring or mixing assembly can reach the corners of the bottom of the container 12, as is described below. Another alternative configuration (not shown) may include a rounded bottom and rounded end walls so that the shape of the container may resemble a truncated toroidal volume.

Figure 3:
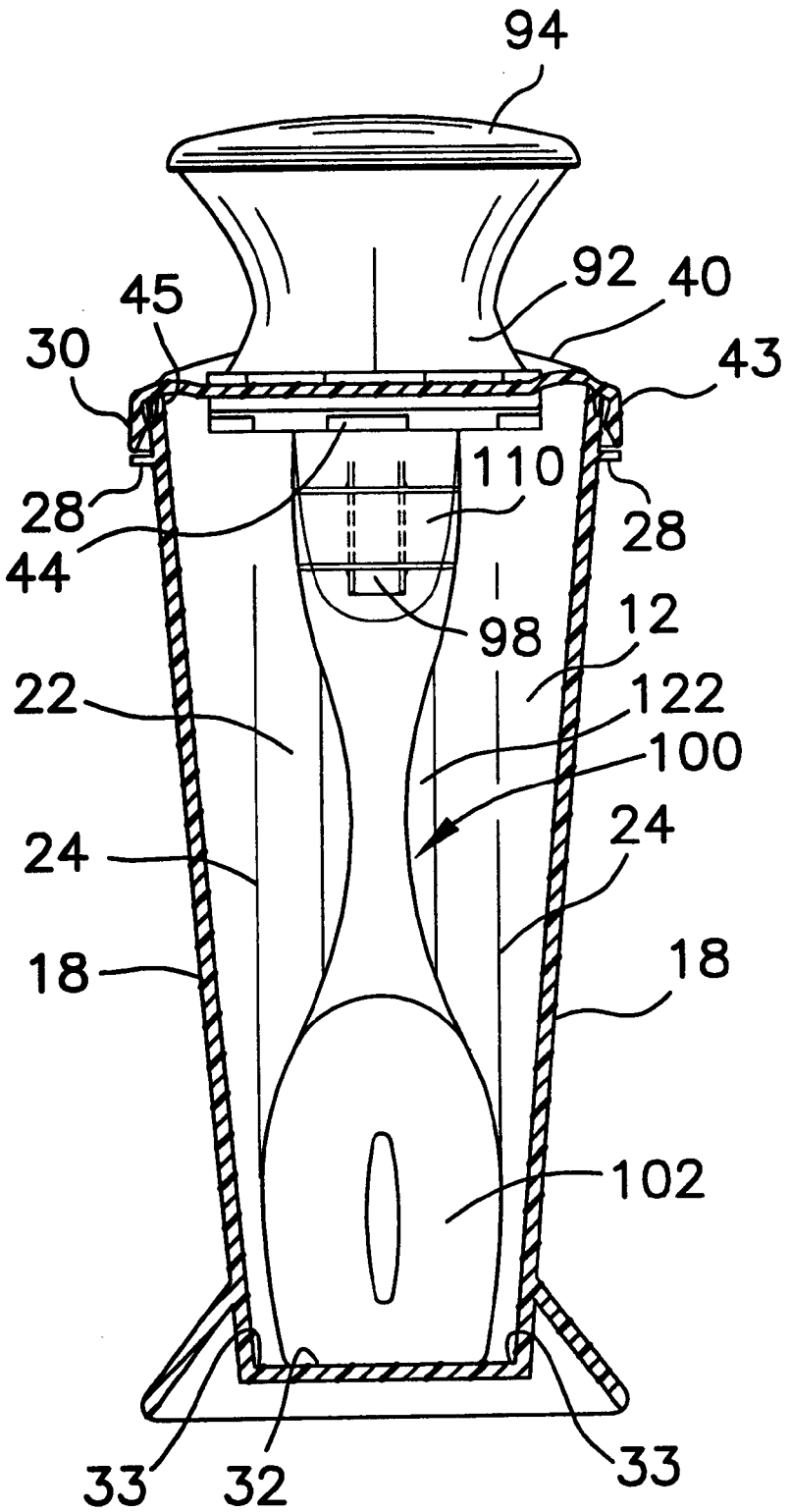
FIG. 3 is a cross-sectional side view of the inventive pitcher, the cross-section being taken approximately along the line 3—3 in FIG. 2.

The container 12 preferably defines a container volume having the attributes of both a rectangular box, including vertical corners 24,26, and an oval cylindrical top or upper container rim 30 (FIG. 3). The shape of container 12 resembles an inverted frustoconical volume which at the top has a much larger oval area, when taken cross-sectionally along a horizontal plane, than when a cross-section is taken at a lower point on the container body. Around the periphery of the top of all walls 18,20,22, almost to the upper rim 30, is a flange or lip 28. The flange 28 can provide a rib for strengthening the container shape and also provides a stop for the cover assembly when it is joined to the container 12.

The inside surfaces of the container 12 essentially follow the outside surfaces except that the base 13 is open toward the bottom. The bottom inner surface 32 or floor of the container 12 is preferably straight in the lateral direction but sweeps a circular arc in the longitudinal direction, as best seen in FIG. 2. As described above, however, alternatively the bottom surface may be curved in the lateral direction (not shown). The locus of the arc for bottom surface 32 is approximately at the upper rim and the radius is approximately the depth or height dimension of the container 12.

The container 12 further comprises a spout 16 on spout wall 20 at the intersection with upper rim 30. Spout 16 protrudes outwardly from spout wall 20, to permit easy pourability of liquids from the container 12. Handle 14, disposed on handle wall 22, can take any number of forms consistent with providing easy handling of the stirring pitcher assembly 10. For example, it is preferable that the handle 14 be large enough to comfortably receive the fingers of most hands. The handle 14 should be disposed on the surface of handle wall 22 closer to the rim 30 than to the base 13.

Figure 6:
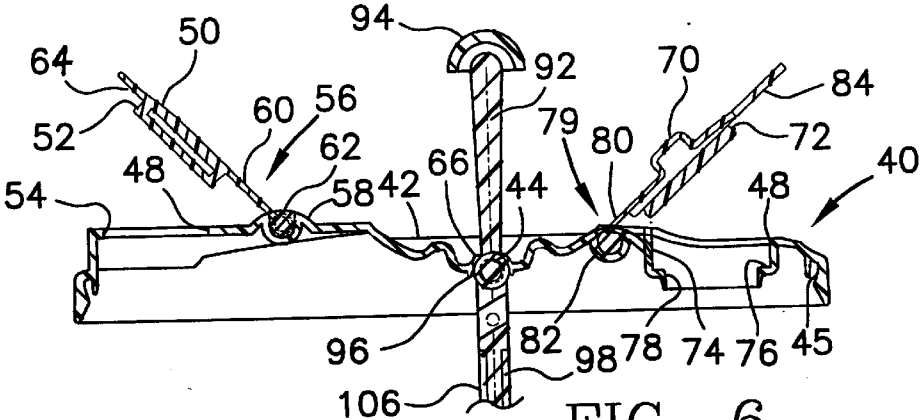
FIG. 6 is a cross-sectional view of the inventive cover assembly, taken approximately along the cross-section line 6—6 of FIG. 5, shown with the attachable elements also in cross-section.

Attached to the container 12 along upper rim 30 is a cover assembly 40, which has an attachment mechanism that sealingly attaches the cover assembly 40 to the rim 30 so that fluid leakage out of the container 12 is prevented from other than through the spout 16. Cover assembly 40 comprises a cover 42, having a downwardly extending rim wall 43 and including a snap groove 45 (FIG. 6). Rim wall 43 preferably describes an oval shape around the edge of cover 42, but other shapes (not shown) are also possible. The cover 42 includes at least two apertures, a handle aperture 44 and a spout aperture 46. Optionally, a third aperture, a cooling stick aperture, 48, is disposed in the cover 42.

Each of the apertures 44, 46 and 48 includes a means for receiving elements which, at least to some extent, block the apertures to maintain a seal for each of the apertures, as will be explained below. For example, the cover assembly 40 includes a spout closure member 50 for covering and sealingly enclosing the spout aperture 46. Spout closure member 50 includes downwardly disposed walls 52, (FIG. 6) which sealingly attach to corresponding walls 54 extending upwardly from the cover 42, and also include a cantilevered spout closure attachment 56 which attaches to the cover assembly 40 at a pivot point 58 disposed toward the central portion of cover assembly 40 between spout 16 and the handle aperture 44. The spout closure attachment 56 may take any number of forms, including a molded unitary connection of the spout closure attachment, such as a strap (not shown) attached directly to cover 40. More preferably, and as shown in FIGS. 1 and 6, the spout closure attachment 56 further comprises a conventional cantilevered pivotable attachment strap 60 having a pivot pin 62 attached at the pivot retainer or mount 58. A spout opening tab 64, preferably being integral with the spout closure member 50, provides an extension handle for removing and replacing the spout closure member in the direction of the arrows 56 from the spout aperture 46.

Removal of the closure member 50 from the spout 16, by pivoting the member 50 about the pivot point provided by pivot retainers 58, opens spout aperture 46 and permits pouring out the liquid in container 12. Conversely, replacement of spout closure member onto the spout 16 sealingly closes spout aperture 46 so as to impede any liquid or air from passing through the spout 16. Of course, the length of the strap 60 or other spout closure member attachment must have a dimension sufficient to extend from the pivot point 58 to the spout aperture 46.

Referring now to FIGS. 1–6, the stirrer aperture 44 is attached to cover 42 to a plurality of pivot mounts 66, about which the stirring handle and spoon combination can rotate. Preferably, the pivot mounts 66 provide a rounded trough 68, (FIG. 4), for receiving the stirring handle/stirring spoon subassembly, as is described below.

The optional cooling stick aperture 48 provides the capability of performing multiple functions. The cooling stick aperture is structurally similar to the spout aperture 46, that is, it also comprises an upwardly extending cover wall 74. However, preferably aperture 48 is in the shape of an oval, rather than circular, like spout aperture 46. A cooling stick closure member 70 (FIG. 6) includes a downwardly extending closure member wall 72 which is shaped and dimensioned to sealingly fit by interference fit within the oval cover wall 74 so as to provide an airtight closure over cooling stick aperture 48. Pivot pin retainers 75 (FIGS. 4 and 5) are disposed between the cooling stick aperture 48 and the stirring assembly aperture 44, for mounting the closure member 70.

The cooling stick aperture 48, however, has one additional feature, most clearly seen in the cross-sectional view of cover assembly 40 in FIG. 6, which preferably is not included the spout aperture 42. Immediately below the cover wall 74 is an inwardly extending flanged lip 76 which includes secondary downwardly extending lip walls 78. The lip 76 provides a mount for the optional cooling stick feature, described below.

The optional cooling stick aperture 48 may also be used to provide access to the volume within container 12. Similar to the spout closure member 50, a closure member attachment 79, such as a strap 80, includes a pivot shaft 82 on one end, which can snap into the pivot retainers 75. The other end of strap 80 is attached to the closure member 70. An extending tab 84 provides an easy to operate handle for opening and closing the cooling stick aperture 48.

Pivoting of the closure member 70 about the pivot shaft 82 within pivot retainers 75 will insert the closure member 70 into the cooling stick aperture 48, so that walls 72 and 74 will, through an interference fit, provide a seal. Pivoting the closure member 70 in the opposite direction permits opening of the cooling stick aperture and provides access for insertion of the cooling stick, described below, or for depositing therethrough solids or liquids to be mixed within the container 12. Preferably, the oval shape of aperture 48 is significantly larger than that of the spout aperture 46 in order to provide readier access to the container 12 for pouring in liquids or depositing solids or powder therein.

Figure 7:
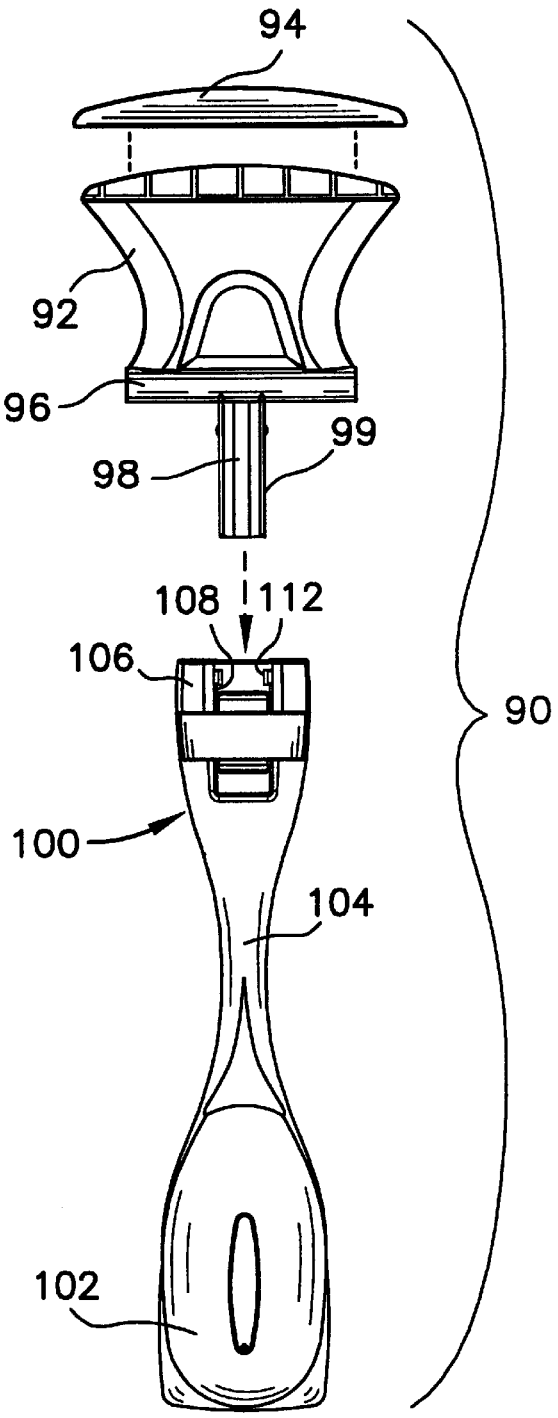
FIG. 7 illustrates one of the attachable elements of the cover assembly shown in FIG. 3.

The stirring handle/spoon assembly 90 is fully illustrated in FIGS. 1, 2, 3 and in a blown-up view in FIG. 7. The subassembly of FIG. 7 illustrates and provides the best view for a description of the quick assembly feature of the assembly 90, which provides one unique feature of this invention. The assembly 90 comprises a handle 92 having an optional grip 94, a transverse pivot pin 96 and an insertion post 98, having a post channel 99.

The assembly 90 further comprises a stirring spoon portion 100, which preferably includes a spoon end 102, a central spoon shaft 104 and an insertion end 106, including a channel 108 for receiving the handle insertion post 98. Preferably, one or more retaining or tightening bands 110 provide a more durable interference fit between the post and the channel 108. Alternatively, or in conjunction with the bands 110, as shown, the channel 108 may include one or more channel inserts 112, which cooperate with the corresponding post channel 99 of similar shape extending longitudinally along the post 98, so as to further increase the retention capability of the channel 108 to hold post 98 by interference fit. The post 98 will be inserted and removed from channel 108 numerous times during long term use of the pitcher 10 for purposes of cleaning. Thus, the more durable the connection between the post 98 and shaft channel 108, the longer the assembly 90 can be utilized for its intended purpose. As explained below, the construction of the post 98 and channel 108 provides a convenient and simple connection between the handle 94 and spoon shaft 104, so that a second installation of the assembly 90 within the pitcher 10 is facilitated.

The handle/spoon assembly 90 is preferably capable of multiple disassembly and reassembly operations. During use of the stirring pitcher 10, the handle 92 extends above the cover assembly 40 and the stirring spoon is disposed below the cover 40 within the container 12, as shown in FIGS. 1–3. The post 98 extends through the stirrer aperture 44, and the transverse stirrer pivot pin 96 snaps into place between the pivot mounts 66 adjacent aperture 46. The structure of the pivot mounts 66 provides a retention capability to retain the stirrer pivot pin 96 releasably attached to the cover 44. However, the pivot pin 96 itself rotates within the transverse rounded channel or trough 68, which has an opposed mating structure that matches the structure of the pivot pin 96. Thus, engagement of the pivot pin 96 by pin mounts 66 within the trough 68 for the most part essentially seals off leakage paths through aperture 44, so that spillage is contained even when the pitcher 10, full of liquid, is laid down on its sidewall 18.

After assembly, stirrer assembly 90 is disposed on either side of cover 42 and is pivotable about the shaft pivot 96 in the direction shown by the arrows (FIG. 2). Pivoting rotational motion of the handle 92, of course, causes the stirring spoon 100 to describe an arc within the container 12 in the opposite direction.

The unique construction of aperture 44, and of the other apertures 46 and 48, provides for a cover which allows only a minimum amount of air to circulate within the container 12, and almost no fluid leakage from pitcher 10, even if the pitcher 10 ends up on its side. The fluid-tight sealing of the spout aperture 46 and of the cooling stick aperture 48 is described above. The structure of pivot pin 96 and the handle post 98 within the pivot mounts 66 within the trough to a great extent closes off any openings for fluid circulation.

Referring now to FIGS. 2, 3 and 6, assembly of the spoon/handle subassembly first requires insertion of the handle post 98 through stirrer aperture 44 and engaging the pivot pin 96 within the pivot mounts 66. Thus, the handle 92 may pivot about the pin 96, in the direction of the arrows as shown (FIG. 2). The spoon shaft 104 may then be brought up from below cover 42 and the shaft post 98 is inserted into channel 108 until the end of post 98 meets the end of channel 108. Following insertion of post 98, sufficient clearance is provided between the end of insertion end 106 and the underside of the cover 42 to permit the spoon/handle assembly 90 to pivot about pin 96.

The cover subassembly 40 is then snapped into place around rim 30, making sure that rim 30 provides a snug interference fit within the snap groove 45 all around the rim 30. The shape of rim 30 and of the corresponding snap groove 45 coact to provide a fluid-tight seal between the rim wall 43 and the rim 30 of container 12.

With cover assembly 40 in place, the spoon end 102 of the stirrer is free to rotate around the container 12 within the sidewalls 18. If the stirring pitcher has been correctly assembled, the spoon end 102 is disposed along the bottom wall 32 of container 12, leaving a slight clearance between them. Thus, the spoon end 102 is free to describe an arc which follows the contour of the arc of bottom wall 32 from one end wall 20 to the other end wall 22. Moreover, as is clearly seen in the cross-sectional view of FIG. 3, there is also a slight clearance between the spoon end 102 and the sidewalls 18, especially at the distal end of the spoon 100. The facing outline or contour of the spoon end follows the contour of the junction of walls 18 with the bottom wall 32 along the complete arc described by bottom wall 32. Thus, rotation of the spoon 100 along the trough formed by walls 18, 32 causes the spoon end 102 to follow very closely adjacent the corners of the trough and to sweep the liquid and solid materials along the bottom wall 32. Liquids and possible entrained solids or powders are then agitated sufficiently to cause all the solids to dissolve, including agitation of all solids which may normally gather at the corners 33 of the trough.

Figure 3A:
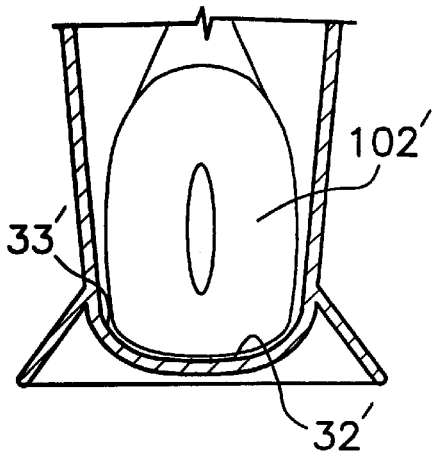
FIG. 3A shows a cross-sectional detail view of an ovoid container bottom, an alternative embodiment of the invention.
Figure 3B:
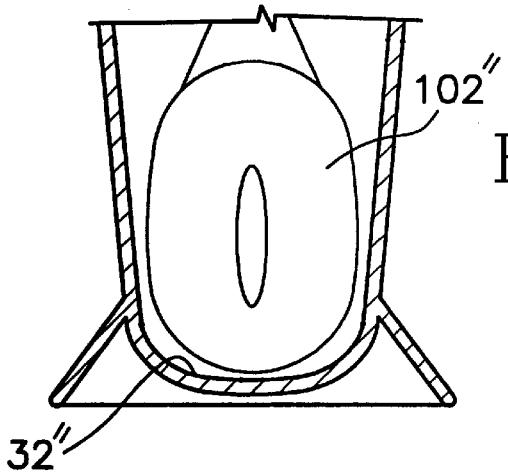
FIG. 3B shows a cross-sectional detail view of a circular container bottom, a second alternative embodiment of the invention.
Figure 4:
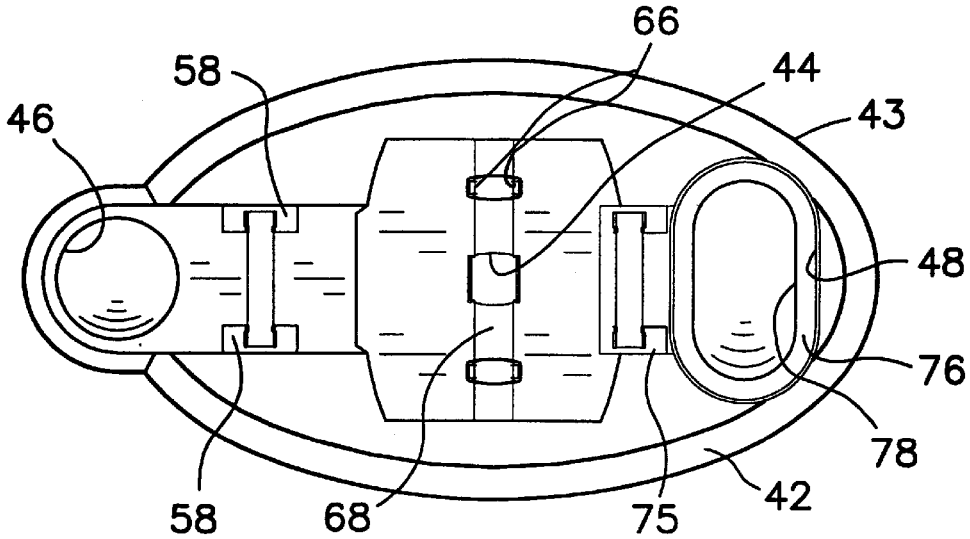
FIG. 4 is a top view of the inventive cover of the stirring pitcher of FIG. 1, shown without the attachable elements.
Figure 5:
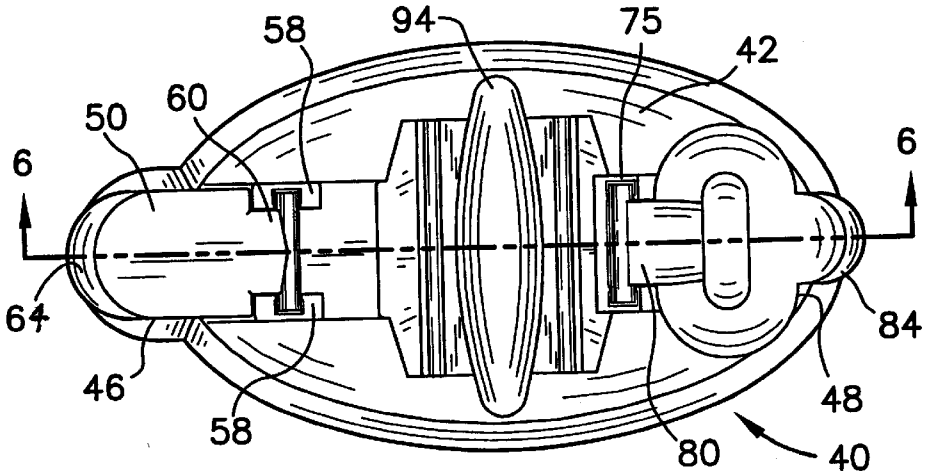
FIG. 5 is a top view of the inventive cover assembly shown with the attachable elements.

Alternative bottom wall structures are possible. For example, in FIG. 3A, an ovoid container bottom wall 32' having rounded corners 33' is matched by a spoon end 102' which is also ovoid in shape. Similarly, in FIG. 3B, circular spoon end 102" follows exactly the contour of a circular container bottom wall 32".

Referring now to FIGS. 1 and 2, an optional cooling stick 120 is shown inserted into the cooling stick aperture 48 and extends into the container 12. The cooling stick comprises a separate container insert 122 which is intended to hold ice cubes or other frozen, freezable or cool material. The material is preferably kept separate from the liquid contained within the pitcher container. The frozen or freezable material may comprise any of the following or similar materials known to the industry: ice, ice cubes, blue ice, THERMAL CERAMICS, or a thermofor.

Preferably, the shape of the separate container insert 122 is an elongated tube which has an oval cross-section matching the oval shape of the cooling stick aperture 48. The length of tubular insert 122 should not exceed the length of the wall 20 of the container 12, so that inserting the tubular insert into the aperture 48 of cover 47 will cause insert 122 to fit within the container 12 without protruding above the cover 42.

Referring now also to FIG. 7, a detailed view of the cooling stick 120 shows the opening 124 at one end. A stopper 126 may be used to enclose or sealingly cover opening 124. The stopper 126 includes a protruding handle portion 128 which extends away from the container 122 and which can be used as a handle for removing the stopper 126 from the container insert 122. A flange 130 extends laterally beyond the edges of opening 124 to hold the tubular insert 170 within the aperture 48.

As illustrated in the drawing Figures, the material of container walls 18, 20 and 22 is a clear plastic material which is transparent. Thus, the elements within container 12, e.g., cooling stick 122 and spoon end 102, are drawn in solid lines, rather than broken lines, to indicate the element which is identified. On the other hand, cover 42 is opaque and the elements behind the downwardly extending cover wall 43 are not shown.

Figure 9:
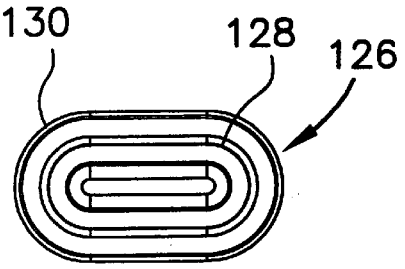
FIG. 9 is a top view of the cooling element shown in FIG. 8.
Figure 8:
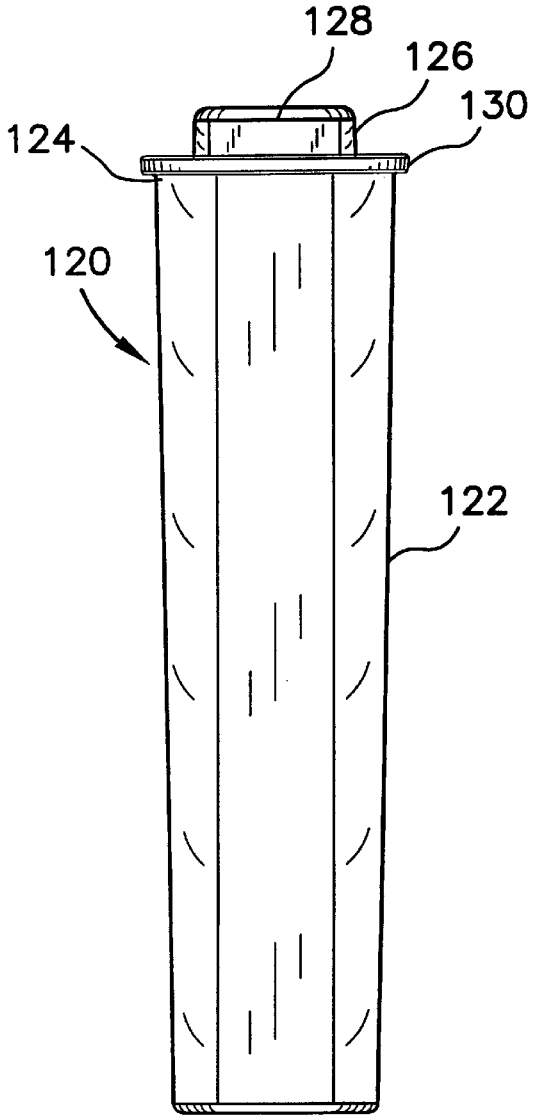
FIG. 8 is an elevational view of a cooling element for optional insertion into the inventive stirring pitcher.

Referring now to FIGS. 6, 8 and 9, the construction of aperture 48, shown in cross-section in FIG. 6, will be described in conjunction with the construction of the tubular insert 120 to show their interaction. As described above, the cooling stick aperture 48 includes a downwardly extending cover wall 74, which preferably has a length somewhat greater than the height of stopper 126, including the handle portion 128. The lateral dimensions of the cover wall 74 exceed slightly the dimensions of the flange 130, so as to accommodate insertion of the stopper 126 within the volume enclosed by the cover wall 74.

The dimension of flanged lip 76 of the aperture 48 does not extend inwardly of the cover wall 74 to such a degree as to interfere with the insertion of the tubular container insert 122 within the aperture; rather, the dimensions of flanged lip 76 and of downwardly extending lip walls 78 are such as to snugly fit over the tubular walls of container insert 122 so as to retain the container insert within the aperture opening. The flanged lip 76 acts also to stop the fill insertion of the container insert 120 into aperture 48 without a means to retain the container insert 120 in place. The flanged lip 76 has a dimension which prevents the stopper flange 130, and thus the stopper 126 and insert container 122, from falling into the container 12.

The cooling stick can provide cooling of the contents in container 12, either through ice contained within container insert 120 or other conventional cooling chemicals. For example, such chemicals are known and available from the assignee hereof, Sierra Housewares, Inc. of Chicago, Ill. The cooling stick is especially convenient when it is not desirable for water to melt from ice and to dilute the contained liquid. For example, a mixed cocktail may have a predetermined recipe, and it is desired that the liquid melting from ice not dilute the drink mixture. Also, for cooling wine or beer, it is undesirable to dilute such liquids with melting ice because dilution from water changes the taste. Thus, the container insert 122 of cooling stick 120 contains and keeps isolated melting ice water or chemicals. Refreezing the water or chemicals after use in the stirring pitcher 10 permits the reuse of the cooling stick 120 in pitcher 10 subsequent to cleaning out the pitcher container 12 and of the stirrer subassembly 90.

Cleaning of the parts of the pitcher 10 also is convenient because the stirrer subassembly 90 can be broken down and cleaned, even in a dishwasher, without great effort. Reassembly of the cover assembly and stirrer subassembly is possible without great effort, as is described above.

Modifications and alterations to the embodiments illustrated and described may become readily apparent once the features of this invention are fully understood. For example, bottom wall 32 is shown extending as an arc in one direction (FIG. 2) and as a straight surface in the lateral direction, as shown in FIG. 3. However, the shape of that surface in the lateral direction may take any of a number of different shapes, for example, a curved or oval surface (not shown), and this will be sufficient to utilize the teachings of this invention as long as the corresponding contour of the spoon end has identical or essentially similar shape or contour to that of the bottom wall.

Accordingly, the invention has been illustrated and described herein in connection with preferred forms of the invention. It will be understood that alterations and modifications may be made thereto while retaining the general scope of the invention. Thus, the invention is described and illustrated above for purposes of description. However, the invention is only limited by the following claims and their equivalents.

What is claimed is:

1. A stirring pitcher comprising:

a) a container having an upwardly facing container opening;

b) a container cover for covering said upwardly facing container opening, said container cover being removable and replaceable over said container opening to open and close said container opening, said container cover further including at least one pivot pin mount, a first aperture and a second spout aperture; and c) a pivotable stirrer adapted for extending through said first aperture of said container cover, said stirrer comprising a spoon end, a central shaft extending from said spoon end along a longitudinal axis, and a stirrer handle attachment end oppositely disposed from said spoon end, and said central shaft including an elongated pivot pin having a pivot pin axis of rotation that is oriented transversely to the shaft longitudinal axis, whereby said stirrer is attachable to said cover at said first aperture such that said elongated pivot pin engages said at least one pivot pin mount on said cover causing said stirrer handle attachment end to extend outside of said cover and said spoon end of said stirrer to extend within said container when said container cover engages said container to cover said container opening, and constraining rotation of the stirrer to a plane transverse to said pivot pin axis of rotation.

2. The stirring pitcher according to claim 1 wherein said stirrer further includes a stirrer subassembly comprising:

a) said stirrer handle attachment end including a handle, said pivot pin further being transversely oriented to said stirrer handle attachment end, said stirrer handle further including an insertion post extending away from said stirrer handle attachment end, and b) a detachable stirring spoon portion, including said central shaft and said spoon end attached to said central shaft, said shaft having an insertion channel at an end opposite said spoon end which is shaped, dimensioned and oriented to receive said handle insertion post, whereby insertion of said insertion post through said first aperture and into said spoon portion insertion channel engages said stirrer handle attachment end with said central shaft such that rotational motion of the stirrer handle about said pivot pin causes said spoon end to rotate in the opposite direction about said pivot pin.

3. The stirring pitcher according to claim 1 wherein said container includes side walls and a bottom wall, said bottom wall of said container describing an arc having a radius of about the distance from said pivot pin to the distal end of said spoon end, and the container bottom defined by said bottom and side walls having a contour which is essentially identical to the contour of said spoon end, whereby rotating said handle about said pivot pin causes said distal end of said stirrer spoon end to describe an arc which tracks the arc of said bottom wall.

4. The stirring pitcher according to claim 3 in which the contour of said spoon end and the contour of said container bottom are rectangular.

5. The stirring pitcher according to claim 3 in which the contour of said spoon end and the contour of said container bottom are ovoid.

6. The stirring pitcher according to claim 3 in which the contour of said spoon end and the contour of said container bottom are circular.

7. The stirring pitcher according to claim 1 wherein said stirrer handle attachment end is detachable from said central shaft and further includes a detachable handle grip which covers a distal end of said stirrer handle attachment end, said detachable handle grip being removed from said pivot pin.

8. The stirring pitcher according to claim 1 in which said container cover second spout aperture is closable and said container cover further includes a closable cooling stick aperture.

9. The stirring pitcher according to claim 8 wherein said container cover further comprises a closing member for sealingly enclosing said second spout aperture.

10. The stirring pitcher according to claim 9 wherein said container cover further comprises a closing member for said cooling stick aperture.

11. The stirring pitcher according to claim 10 wherein said closing members for said second spout and for said cooling stick apertures each include a pivot for engaging separate pivot mounts disposed on said container cover, each of said pivots permitting one of said closing members to pivot about an associated one of said pivot mounts.

12. The stirring pitcher according to claim 8 further comprising a cooling member insertable into said pitcher container, said cooling member including a closable cavity for receiving a cooling means and an enclosure member for enclosing the cooling member so as to isolate the cooling member cavity from said pitcher container when said cooling member is inserted into said pitcher container.

13. The stirring pitcher according to claim 12 wherein said cooling stick aperture further includes a constricting side wall for retaining said insertable cooling member within said cooling stick aperture, said cooling stick aperture and said cooling member being shaped and dimensioned to permit said cooling member to close said cooling stick aperture after said cooling member has been inserted within said cooling stick aperture.

14. The stirring pitcher according to claim 12 wherein said cooling means further comprises ice.

15. The stirring pitcher according to claim 12 wherein said cooling means further comprises a freezable chemical composition.

16. The stirring pitcher according to claim 15 wherein said freezable chemical composition further comprises one of blue ice, Thermal Ceramics or a thermofor.

17. A stirring pitcher comprising:

a) a container having at least two side walls, a bottom wall, and an upwardly facing container opening, whereby said container defines an elongated trough;

b) a container cover for covering said upwardly facing container opening, said container cover being removable and replaceable over said container opening to open and close said container opening, said container cover further including at least one pivot pin mount and at least a first aperture; and c) a pivotable stirrer adapted for extending through said first aperture of said container cover, said stirrer comprising a spoon end, a central shaft extending from said spoon end along a longitudinal axis, and a stirrer handle attachment end oppositely disposed from said spoon end, and said central shaft including a pivot pin oriented transversely to the shaft longitudinal axis, whereby said stirrer is attachable to said cover adjacent said first aperture such that said pivot pin engages said at least one pivot pin mount on said cover, thereby causing said handle attachment end of said stirrer to extend outside of said cover and said spoon end of said stirrer to extend within said container when said container cover engages said container to cover said container opening, wherein said bottom wall of said container describes an upwardly facing arc having a radius of about the distance from said stirrer pivot pin to the distal end of said spoon end whereby rotating said handle about said pivot pin causes said distal end of said stirrer spoon end to describe an arc which tracks said arc of said bottom wall.

18. The stirring pitcher according to claim 17, wherein said cover further includes a second aperture disposed adjacent one lateral end of said container side walls, said container further including a removable and replaceable stopper for said second aperture, said stopper being attachable to said cover.

19. The stirring pitcher according to claim 17 in which the contour of said spoon end and the contour of said container bottom are rectangular.

20. The stirring pitcher according to claim 17 in which the contour of said spoon end and the contour of said container bottom are ovoid.

21. The stirring pitcher according to claim 17 in which the contour of said spoon end and the contour of said container bottom are circular.

* * * * *